US008291973B2

(12) United States Patent
Johnson et al.

(10) Patent No.: US 8,291,973 B2
(45) Date of Patent: Oct. 23, 2012

(54) OFFSET JOINT FOR DOWNHOLE TOOLS

(75) Inventors: Timothy Joseph Johnson, Calgary (CA); Phillip Paul Hnatiuk, Sherwood Park (CA)

(73) Assignee: General Electric Company, Schenectady, NY (US)

( * ) Notice: Subject to any disclaimer, the term of this patent is extended or adjusted under 35 U.S.C. 154(b) by 291 days.

(21) Appl. No.: 12/724,641

(22) Filed: Mar. 16, 2010

(65) Prior Publication Data

US 2011/0226468 A1 Sep. 22, 2011

(51) Int. Cl.
*E21B 17/02* (2006.01)

(52) U.S. Cl. ..... 166/242.6; 166/242.5; 166/65.1

(58) Field of Classification Search ..... 166/65.1, 166/117.5, 242.5, 242.6; 285/2, 3, 4
See application file for complete search history.

(56) References Cited

U.S. PATENT DOCUMENTS 4,715,440 A * 12/1987 Boxell et al. ..... 166/100
4,979,585 A * 12/1990 Chesnutt ..... 181/102
5,470,118 A * 11/1995 Burton ..... 294/86.18
5,836,388 A 11/1998 Tchakarov
6,116,337 A 9/2000 Civarolo
6,484,801 B2 * 11/2002 Brewer et al. ..... 166/65.1
7,131,497 B2 11/2006 Helms et al.
7,252,143 B2 * 8/2007 Sellers et al. ..... 166/217

* cited by examiner

*Primary Examiner* — Giovanna Wright
*Assistant Examiner* — Richard Alker
(74) *Attorney, Agent, or Firm* — Pearne & Gordon, LLP

(57) ABSTRACT

A variable offset joint is provided for downhole tools, including a first downhole member, a second downhole member, and at least one intermediate element pivotally coupled at a first end to the first downhole member and at a second end to the second downhole member. The variable offset joint further includes a coupler member adapted to maintain a predetermined lateral offset between the first and second downhole members. The coupler member further includes a zone of weakness adapted to fracture when a tensile force applied thereto exceeds a predetermined threshold. In one example, a plurality of intermediate elements are each pivotally coupled to the first and second downhole members. In another example, the coupler member extends between at least two of the plurality of intermediate elements. In another example, adjusting a length of the coupler member selectively adjusts the predetermined lateral offset.

15 Claims, 4 Drawing Sheets

OFFSET JOINT FOR DOWNHOLE TOOLS

BACKGROUND OF THE INVENTION

1. Field of the Invention

The invention relates to downhole tools, and specifically relates to a variable offset joint for downhole tools.

2. Discussion of Prior Art

Well boreholes are typically drilled in earth formations to produce fluids from one or more of the penetrated formations. The fluids include water and hydrocarbons, such as oil and gas. Well boreholes are also drilled in earth formations to dispose waste fluids in selected formations penetrated by the borehole. The boreholes are typically lined with tubular structure commonly referred to as casing. Casing is typically steel, although other metals and composites such as fiberglass can be used. Grouting material, such as cement, fills the casing-borehole annulus to hydraulically isolate various formations penetrated by the borehole and casing.

The wall of the casing can be thinned. Corrosion can occur both inside and outside of the casing. Mechanical wear from pump rods and the like can wear the casing from within. Casing wear can affect the casing's ability to provide mechanical strength for the borehole. In addition or alternatively, various grouting problems can compromise hydraulic isolation of the casing, such as improper bonding, incomplete filling of the casing-cement annulus, and/or casing corrosion/wear.

Measures of one or more of the borehole parameters of interest are useful over the life of the borehole, extending from the time that the borehole is drilled until the time of abandonment. It is therefore economically and operationally desirable to operate equipment for measuring various borehole parameters using a variety of borehole survey or "logging" systems. Such logging systems can include multiconductor logging cable, single conductor logging cable, and/or production tubing.

Generally, downhole tools are lowered through the inner diameter of the casing tubing for various purposes. Some tools are provided with power through electrical conductors while other tools are battery-powered. Downhole tools may include a number of modules with lengths up to thirty feet, or even more.

Boreholes and associated casing may vary over a wide range of diameters. The casing inside diameter can also vary due to corrosion, wear, or other obstructions. It can be desirable for a borehole tool to operate over a range of borehole diameters.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

One aspect of the invention provides a variable offset joint for downhole tools, including a first downhole member, a second downhole member, and a plurality of intermediate elements each pivotally coupled at a first end to the first downhole member and at a second end to the second downhole member. The variable offset joint further includes a coupler member extending between at least two of the plurality of intermediate elements and adapted to selectively maintain a lateral offset between the first and second downhole members. The coupler member further includes a zone of weakness adapted to fracture when a tensile force applied thereto exceeds a predetermined threshold.

Another aspect of the invention provides a variable offset joint for downhole tools, including a first downhole member, a second downhole member, and a plurality of intermediate elements each pivotally coupled at a first end to the first downhole member and at a second end to the second downhole member. The variable offset joint further includes a coupler member extending between at least two of the plurality of intermediate elements and adapted to maintain each of the first and second downhole members at a predetermined angle relative to at least one of the plurality of intermediate elements. The coupler member is further adapted to fracture when a tensile force applied thereto exceeds a predetermined threshold.

Another aspect of the invention provides a variable offset joint for downhole tools, including a first downhole member, a second downhole member, and at least one intermediate element pivotally coupled at a first end to the first downhole member and at a second end to the second downhole member. The variable offset joint further includes a coupler member adapted to maintain a predetermined lateral offset between the first and second downhole members such that adjusting a length of the coupler member selectively adjusts the predetermined lateral offset. The coupler member is further adapted to irreversibly reduce the lateral offset between the first and second downhole members when a tensile force applied thereto exceeds a predetermined threshold.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
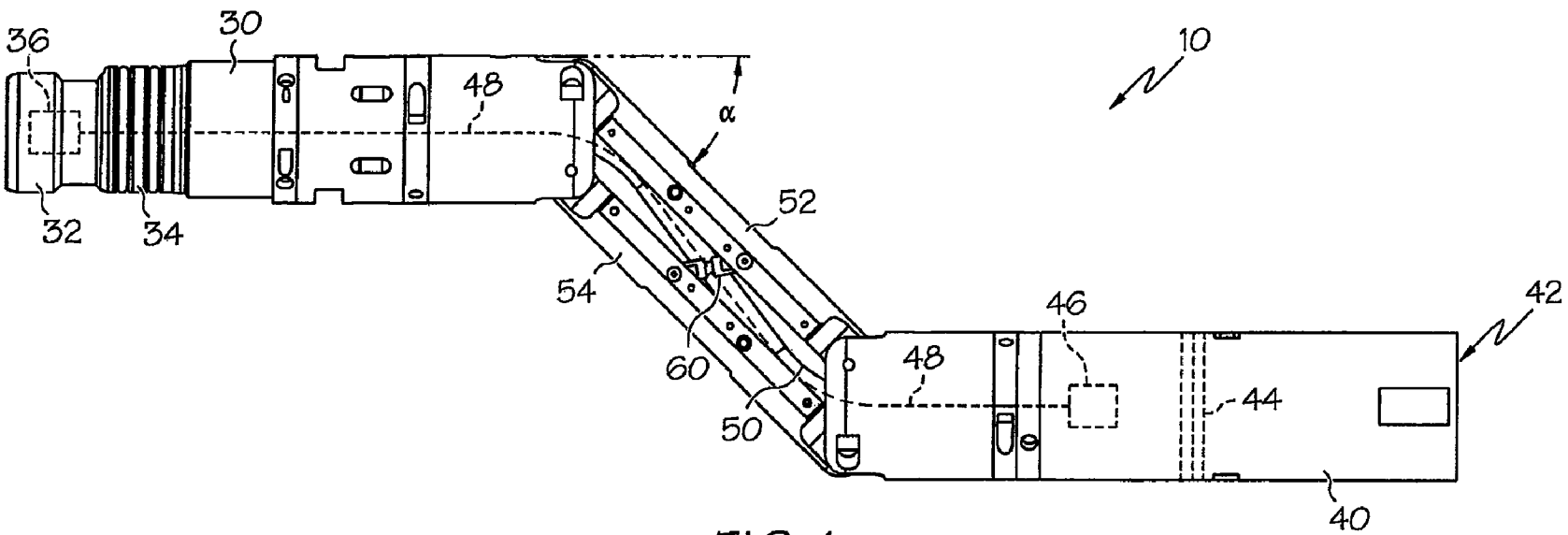
FIG. 1 is a side view of an example variable offset joint for downhole tools.

Example embodiments that incorporate one or more aspects of the invention are described and illustrated in the drawings. These illustrated examples are not intended to be a limitation on the invention. For example, one or more aspects of the invent ion can be utilized in other embodiments and even other types of devices. Moreover, certain terminology is used herein for convenience only and is not to be taken as a limitation on the invention. Still further, in the drawings, the same reference numerals are employed for designating the same elements.

For the purposes of this disclosure, the term "tool" is very generic and may be applied to any device sent downhole to perform any operation. Particularly, a downhole tool can be used to describe a variety of devices and implements to perform a measurement, service, or task, including, but not limited to, pipe recovery, formation evaluation, directional measurement, drilling operations, and/or workover.

Figure 2:
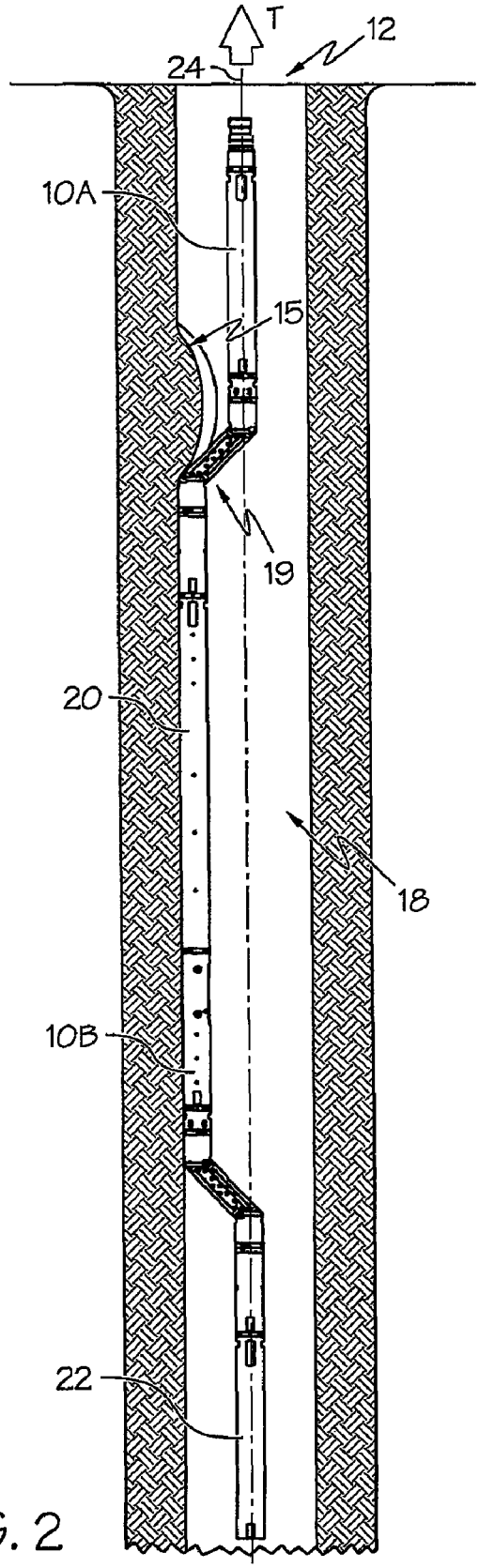
FIG. 2 is a side view of an example toolstring within an example borehole, including a plurality of the variable offset joints of FIG. 1.

Turning to FIGS. 1-2, an example embodiment of a variable offset joint 10 FIG. 1) is illustrated. The variable offset joint 10 is adapted for use in a borehole 12 (FIG. 2) in the earth that can be lined with a tubular casing (not shown) secured with various grouting materials (not shown), such as cement or the like. The variable offset joint 10 can be adapted to be part of a toolstring 18 including one or more variable offset joints 10A, 10B and one or more downhole tools 20, 22. It is contemplated that various other structure can also be provided as part of the toolstring 18.

The toolstring 18 is generally deployed towards the center of the borehole 12, such as along a central axis 24 of the borehole 12. However, for various reasons known by one of skill in the art, it is often desirable to locate the various downhole tools 20, 22 at various distances offset from the central axis 24. For example, as shown in FIG. 2, one downhole tool 20 can be disposed adjacent the wall of the borehole 12 (i.e., disposed with a relatively greater lateral offset) while the other downhole tool 22 can be disposed away from the wall of the borehole 12 (i.e., disposed with a relatively lesser lateral offset). The variable offset joint 10 can be selectively adjusted to provide the desired offset distances, as will be discussed herein.

The variable offset joint 10 (FIG. 1) can include a first downhole member 30 disposed at one end, and a second downhole member 40 disposed at the other end. As used herein, the terms "first" and "second" are used only for convenience. The first and second downhole members 30, 40 can each include an end 32, 42, respectively, having coupling structure (e.g., field joints) adapted to couple the variable offset joint 10 with another joint, downhole tool, etc. As shown, the end 32 of the first downhole member 30 can include male coupling structure, such as a keyed male end and/or an externally threaded connection 34, while the end 42 of the second downhole member 40 can include female coupling structure, such as a hollow tubular receiving structure and/or an internally threaded connection 44. Still, either end 32, 42 can include various configurations, including various other coupling structure known to one of skill in the art.

In addition, the variable offset joint 10 can include at least one electrical coupler. For example, at least one electrical coupler 36, 46 can be provided to each of the ends 32, 42, and at least one wire 48 can extend between the electrical couplers 36, 46 for communicating electrical current therebetween. The electrical couplers 36, 46 can be configured to be coupled to various corresponding electrical and/or mechanical structure(s) for transferring the electrical current. The electrical current can provide various digital and/or analog signals, such as electrical power, communication, etc. between the various downhole tools, couplers, and control structure (not shown) provided outside of the borehole 12. In addition or alternatively, various other signals for providing power, communication, etc. can be provided by various other structures, including optical signals (e.g., via fiber optic cable, etc.), wireless signals (e.g., via electromagnetic transmission, etc.), or the like. Any or all of the signal structure, such as the wire(s) 48, can be protected, shielded, etc. in various manners. For example, a sealed tubing 50, which may be flexible, can extend between the electrical couplers 36, 46 and enclose the at least one wire 48. The sealed tubing 50, which may be monolithic or formed of various elements, can be sealingly coupled to either or both of the electrical couplers 36, 46. Coupling structure at either of the ends 32, 42 can also include various sealing structure or the like.

The variable offset joint 10 can further include at least one intermediate element pivotally coupled at a first end to the first downhole member 30, and at a second end to the second downhole member 40. In the shown example, a plurality of intermediate elements 52, 54 can each be pivotally coupled at a first end to the first downhole member 30 and at a second end to the second downhole member 40. Though two intermediate elements 52, 54 are illustrated, various numbers and/or configurations of intermediate elements can be provided. The plurality of intermediate elements 52, 54 can be adapted to maintain the first downhole member 30 generally parallel with the second downhole member 40, or alternatively can be adapted to maintain the first and second downhole members 30, 40 at various angles relative to each other.

Figure 3:
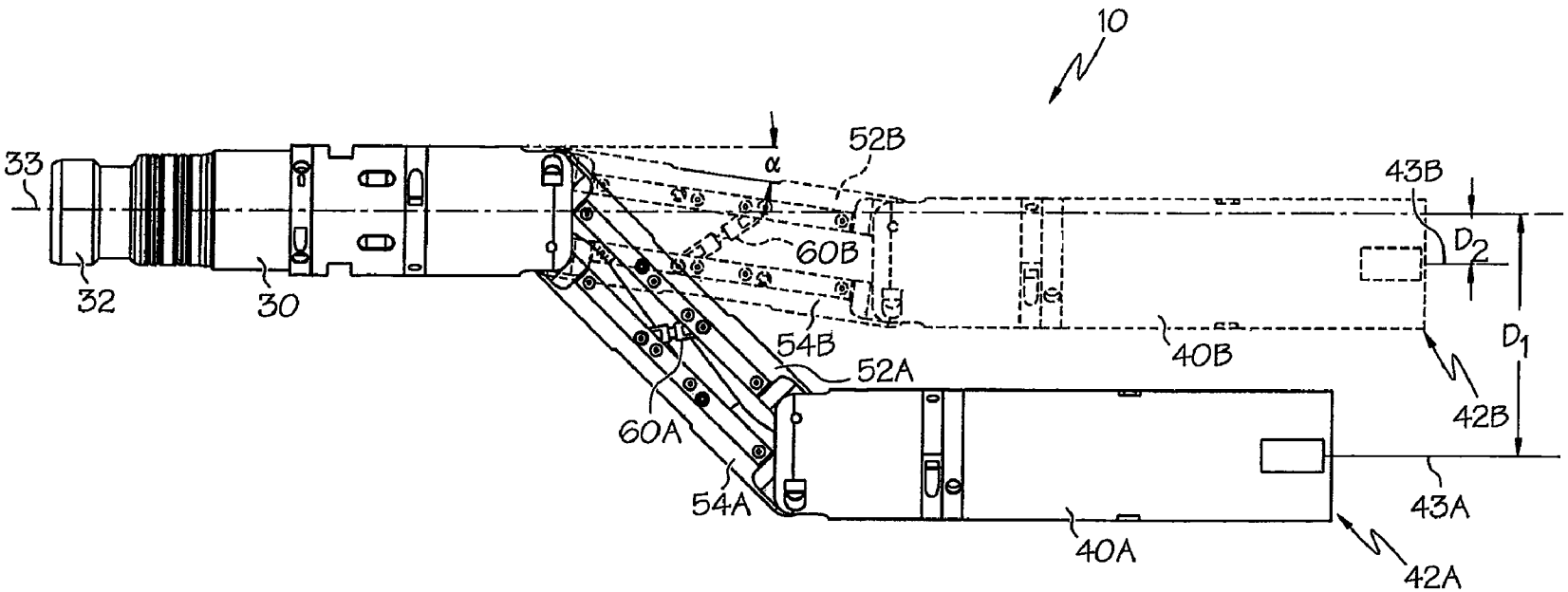
FIG. 3 is a side view of the variable offset joint of FIG. 1 illustrated in two example offset positions.
Figure 4:
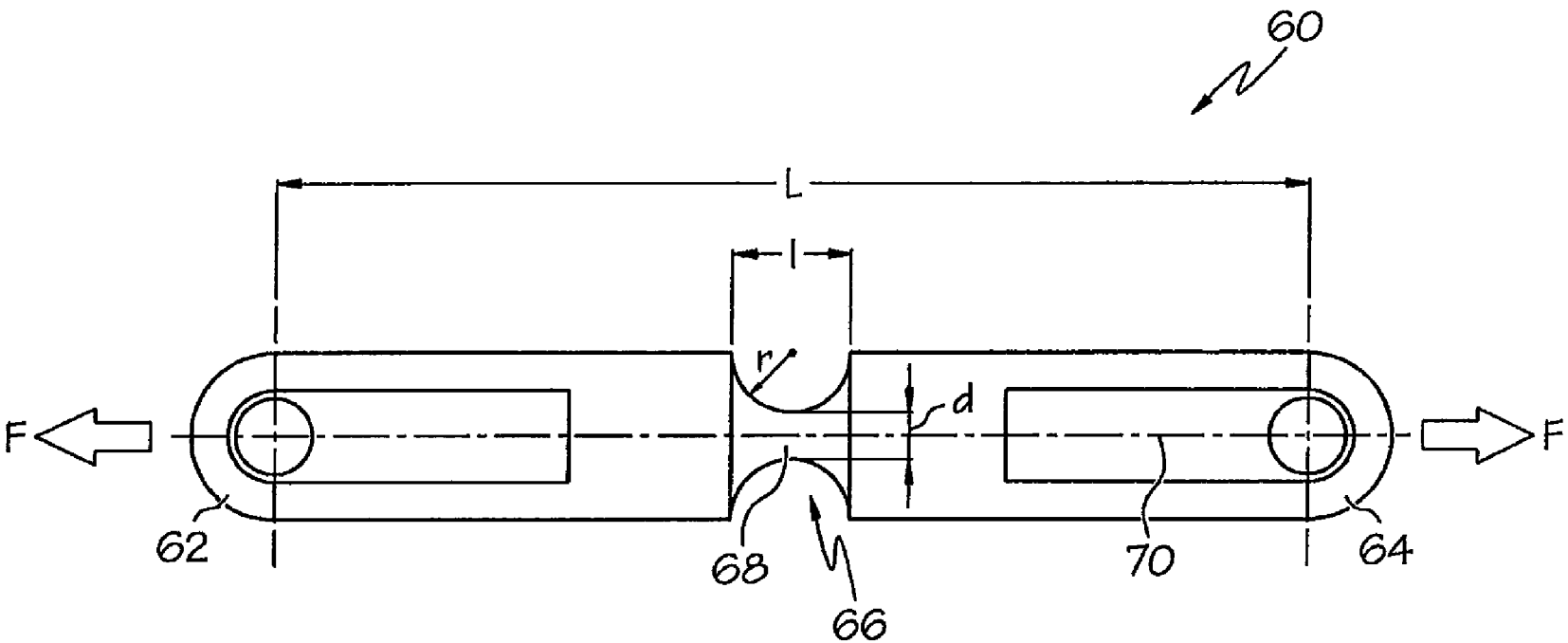
FIG. 4 is a side view of an example coupler member.

Turning now to FIGS. 3-4, the variable offset joint 10 can further include a coupler member 60 adapted to selectively maintain a predetermined lateral offset between the first and second downhole members 30, 40, as described more fully herein. When performing an operation on a well, several of the tool types in the toolstring 18 are often decentralized in the borehole, while others function along the central axis 24 of the borehole. To be able to log all of the tools in the toolstring 18 in their appropriate radial position, the variable offset joint 10 can permit a portion of the toolstring 18, such as one or more of the borehole tool(s) 20, 22, to selectively operate over a range of borehole diameters. For convenience, the lateral offset between the first and second downhole members 30, 40, as described herein, will be taken to mean a lateral offset distance between a centerline 33 of the first downhole member 30, and a respective centerline 43A, 43B of the second downhole member 40. Still, it is to be understood that the lateral offset can be taken with reference to various other portions of the variable offset joint 10. Also, for convenience, the reference numbers in FIG. 3 for the second downhole member 40 and coupler member 60 utilize the letters "A" and "B" to denote the same element in different offset positions.

In one shown example, the coupler member 60 can extend between at least one intermediate element 52, 54 and one of the first and second downhole members 30, 40 to selectively maintain the predetermined lateral offset between the first and second downhole members 30, 40. The coupler member 60 is disposed in a manner whereby it experiences generally tensile loading. The coupler member 60 can be pivotally coupled in a removable or non-removable manner to facilitate installation and/or removal.

In another shown example, the coupler member 60 can extend between at least two of the plurality of intermediate elements 52, 54 to selectively maintain the predetermined lateral offset between the first and second downhole members 30, 40. The coupler member 60 is disposed in a manner whereby it experiences generally tension loading. The coupler member 60 can be pivotally coupled to either or both of the intermediate elements 52, 54 to facilitate installation and/or removal. Either or both ends 62, 64 (FIG. 4) of the coupler member 60 can be removable or non-removably coupled to the intermediate elements 52, 54. In one example, the ends 62, 64 of the coupler member 60 can be provided with holes through which shoulder bolts or other mechanical structure can be used. The holes may be provided with rotational support structure, such as bushings, bearings, etc. The coupler member 60 can be disposed variously along the lengths of the intermediate elements 52, 54. In the shown example, the coupler member 60 can be attached to a generally middle portion of each of the intermediate elements 52, 54, though various other attachment points are contemplated.

The coupler member 60 inhibits, and can prevent, relative movement of the intermediate elements 52, 54 relative to each other, such that the first and second downhole members 30, 40 are similarly inhibited or prevented from moving relative to each other. For example, one end of the coupler member 60 can be attached to one of the intermediate elements 52. Both of the intermediate elements 52, 54 can be pivoted to provide the desired lateral offset between the first and second downhole members 30, 40, and then the other end of the coupler member 60 can be attached to the other intermediate element 54 to thereby fix and maintain the desired lateral offset between the first and second downhole members 30, 40.

Where the intermediate elements 52, 54 are pivotally coupled to the first and second downhole members 30, 40 and the intermediate elements 52, 54 are maintained generally parallel to each other, a lateral offset between the first and second downhole members 30, 40 will also position the intermediate elements 52, 54 at an angle $\alpha$ (see FIG. 3) relative to either or both of the first and second downhole members 30, 40. Thus, the coupler member 60 can further be adapted to maintain each of the first and second downhole members 30, 40 at a predetermined angle relative to at least one of the plurality of intermediate elements 52, 54. Indeed, each predetermined angle can correspond to a predetermined lateral offset, such that adjusting for a predetermined angle $\alpha$ can thereby adjust the lateral offset. In various examples, the predetermined angle can be adjustable within a range of about 5 degrees to about 45 degrees, though other greater or lesser values are contemplated. It is to be understood that the example predetermined angle $\alpha$ is illustrated (i.e., see FIGS. 1 and 3) between the first downhole member 30 (i.e., such as along a line parallel to the centerline 33) and one of the intermediate members 54A, 54B, and that other complementary angles taken between other reference points are also contemplated to be within the scope of this disclosure.

As illustrated in FIG. 3, adjusting a length of the coupler member 60 extending between the intermediate elements 52, 54 can thereby adjust the lateral offset between the first and second downhole members 30, 40, and/or the angle $\alpha$. For example, the lateral offset between the first and second downhole members 30, 40 can be adjustable to provide a range of operation within a well or borehole having a diameter between about six inches and about sixteen inches, though other values are contemplated. Thus, as shown in shown in FIG. 3, relatively decreasing the effective length L of the coupler member (see 60A) can thereby increase the angle $\alpha$ to thereby increase the lateral offset ($D_2$) between the first downhole member 30 and the second downhole member (see 40A). Correspondingly, as shown in phantom, relatively increasing the effective length L of the coupler member (see 60B) can thereby decrease the angle $\alpha$ to thereby decrease the lateral offset ($D_2$) between the first downhole member 30 and the second downhole member (see 40B).

The effective length L of the coupler member 60 can be adjusted in various manners. In one example, the coupler member 60 can be provided with adjustable structure, such as by a threaded connection and/or telescoping connection (not shown) between the ends 62, 64 thereof to selectively adjust the effective length L. In another example, one portion of the coupler member 60 can be selectively replaced with another of a different size and/or length (not shown) to selectively adjust the effective length L. In another example, as shown, the coupler member 60 can be a generally monolithic element with a fixed length, whereby the effective length L of the coupler member 60 is selectively adjusted by replacing the entire coupler member 60 with a different coupler member having a different length. For example, if the coupler member (e.g., 60A) is replaced with a relatively longer coupler member (e.g., 60B), the angle $\alpha$ will decrease which will cause a decrease in the lateral offset between the first and second downhole members 30, 40B. Thus, one variable offset joint 10 can be provided with a plurality of coupler members (e.g., exchanging 60A and 60B) having different lengths corresponding to different predetermined lateral offsets between the first and second downhole members 30, 40 (e.g., positions for 40A, 40B). In still yet other examples, not shown, the coupler member 60 can have a plurality of holes or openings at the ends 62, 64 thereof for coupling to the intermediate elements 52, 54, and/or the intermediate elements 52, 54 can each have a plurality of holes or openings along the length thereof for coupling to the coupler member 60. In either case, the effective length L can be selectively adjusted by choosing different ones, such as different combinations, of the holes or openings of the coupler member 60 and/or intermediate elements 52, 54. As a result, the effective length L of the coupler member 60 can establish the lateral offset between the first and second downhole members 30, 40, as well as the angle $\alpha$.

As shown in FIG. 2, a portion 19 of the toolstring 18 can become stuck on an obstruction 15 or the like within the borehole 12. Conventionally, when a toolstring 18 becomes stuck in the well, subsequent removal costs and rig time can be extremely expensive and leaving tools in the wellbore is generally undesirable. Additionally, increased tensile loads applied to the toolstring 18 in an effort to dislodge it from the borehole 12 can damage the toolstring 18 and/or associated equipment.

Turning now to FIG. 4, an example coupler member 60 is illustrated. Because the coupler member 60 is disposed in the variable offset joint 10 in a manner whereby it experiences generally tensile loading, the coupler member 60 can further include a zone of weakness 66, such as a frangible portion or relatively weakened region, adapted to fracture when a tensile force applied thereto exceeds a predetermined threshold. Thus, the zone of weakness 66 can break under predetermined load in case the toolstring 18 is stuck in the well, allowing the offending offset to be straightened for easier removal of the toolstring 18. Upon fracture of the zone of weakness 66, the coupler member 60 is broken into two or more pieces such that the plurality of intermediate elements 52, 54 are de-coupled, and the lateral offset between the first and second downhole members 30, 40 will no longer be maintained at the predetermined value. Instead, under the force of gravity, the lateral offset will move to a reduced, such as minimum, position. As can be appreciated, one minimum position can be a lateral offset of substantially zero, such that the first and second downhole members 30, 40 are both generally aligned along the central axis 24 of the borehole 12. Still, it is to be understood that the geometry of the variable offset joint 10 may determine a minimum position of the lateral offset that is different from substantially zero.

Thus, upon fracture of the zone of weakness 66, the coupler member 60 can be adapted to irreversibly reduce the lateral offset between the first and second downhole members 30, 40 when the tensile force applied thereto exceeds a predetermined threshold. The zone of weakness 66 (i.e., frangible portion or relatively weakened region) can include various geometries. In one example, the zone of weakness 66 can include a frangible neck 68 sized to fracture when mechanical stress applied thereto exceeds the predetermined threshold. The frangible neck 68 can also include various geometries. For example, the frangible neck 68 can include a reduced cross-sectional area that is configured as a body of revolution about an axis of symmetry, such a central axis 70 of the coupler member 60. In one example, the frangible neck can be sized to fracture when mechanical stress applied thereto exceeds a predetermined threshold that is based upon a tensile force F of about 2,500 to about 8,000 pounds applied to the coupler member 60. For example, a toolstring retrieval force T can be applied generally parallel to the central axis 24 of the borehole 12 in an attempt to dislodge the stuck toolstring 18. Based on the geometry of the variable offset joint 10, the toolstring retrieval force T can translate via force vectors into the tensile force F on the coupler member 60. When the tensile force F exceeds the predetermine threshold, such as about 2,500 to about 8,000 pounds, the coupler member 60 will fracture. It is to be understood that the predetermined threshold for the mechanical stress applied to the frangible neck 68 can also be based upon various other force values.

Variations in the material properties and/or geometry of the coupler member 60, such as about the frangible neck 68, can permit customization of the zone of weakness 66 based upon a known breaking strength of the material and geometry thereof. The breaking strength is generally accepted to be the stress value on a stress-strain curve at the point of rupture. In one example, the frangible neck 68 can be customized by variations in material properties and/or geometry to vary the predetermined threshold of the breaking strength, based upon different amounts of force applied to at least one of the first and second downhole members 30, 40. Thus, where a more delicate toolstring 18 is used, the predetermined threshold for the frangible neck can be decreased to reduce, such as minimize, potential damage to the toolstring 18. Conversely, where a more rugged toolstring 18 is used, the predetermined threshold for the frangible neck can be increased. One toolstring can even include multiple coupler members 60 each having different predetermined fracture values, such as one with a low fracture force value and one with a high fracture force value, or even other predetermined characteristics, such as one with a quick breakage characteristic and one with a slow breakage characteristic, etc. Each of the multiple coupler members 60 can receive a portion of the toolstring retrieval force T. Further, by the nature of the instant design, a user need only replace the broken coupler member 60 with another that is adapted to fracture when a tensile force applied thereto exceeds another predetermined threshold, which can be the same or different. As a result, a user can have a relatively high degree of confidence for retrieving a stuck toolstring 18.

In addition to customizing the zone of weakness 66 to provide for different predetermined thresholds, the zone of weakness can also be customized for each of the various length coupler members 60. For example, as shown in FIG. 3, the geometric positioning of the various components of the variable offset joint 10 is different for the different predetermined lateral offsets, which provides for different force vectors. The force vectors can be based at least in part upon the angle $\alpha$ and/or geometry of the coupler member 60. That is, for a toolstring retrieval force T (FIG. 2) applied to the first downhole member 30, the tensile force vector experienced by the zone of weakness of the coupler member 60A (i.e., corresponding to a relatively larger lateral offset) will be different from the tensile force experienced by the zone of weakness of the coupler member 60B (i.e., corresponding to a relatively smaller lateral offset). Thus, various properties of the zone of weakness 66 can be adjusted to provide for fracture of the coupler member 60 when the tensile force F applied thereto exceeds the predetermined tensile force value of about 2,500 to about 8,000 pounds (or other desired value). Example properties can include, but are not limited to, length (l), cross-sectional area (e.g., such as based on a cross-sectional diameter (d)), and/or tapered radius (r) of the frangible neck 68, and/or different material properties of the material(s) forming the frangible neck 68. The material properties of the frangible neck 68 can be adjusted by replacing materials and/or by various mechanical working or heat treatment thereof, etc.

The results of one example geometry calculation for an example coupler member 60 will now be provided, based upon a material (e.g., steel) having a nominal stress of 35,000 pounds per square inch (psi) and a predetermined lateral offset between the first and second downhole members 30, 40 of about 6 inches. Based upon these parameters and the resultant geometry of the related components of the variable offset joint 10, a frangible neck 68 having a geometry with a length (l) of about 1.6 inches, a cross-sectional diameter (d) of about 0.2 inches, and a tapered radius (r) of about 0.1 inches will provide for fracture of the frangible neck 68 when the tensile force F applied to the coupler member 60 is about 2,500 to about 8,000 pounds. It is to be understood that various other values can be used based upon adjusting the properties of the various components.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A variable offset joint for downhole tools, including:

a first downhole member;

a second downhole member;

a plurality of intermediate elements each pivotally coupled at a first end to the first downhole member and at a second end to the second downhole member; and a coupler member extending between first and second of the plurality of intermediate elements, with a first end of the coupler member being pivotally attached directly to the first intermediate element and a second end of the coupler member being pivotally attached directly to the second intermediate element, and adapted to selectively maintain a lateral offset between the first and second downhole members, the coupler member further including a zone of weakness adapted to fracture when a tensile force applied thereto exceeds a predetermined threshold.

2. The variable offset joint of claim 1, wherein an effective length of the coupler member establishes the lateral offset between the first and second downhole members.

3. The variable offset joint of claim 2, wherein the lateral offset between the first and second downhole members is sufficient to accommodate a range of operation within a well having a diameter between about six inches and about sixteen inches.

4. The variable offset joint of claim 1, wherein the length of the coupler member establishes a predetermined angle defined between at least one of the first and second downhole members and at least one of the plurality of intermediate members to thereby establish the lateral offset between the first and second downhole members.

5. The variable offset joint of claim 4, wherein the predetermined angle is the range of about 5 degrees to about 45 degrees.

6. The variable offset joint of claim 1, wherein the zone of weakness includes a frangible neck sized to fracture when mechanical stress applied thereto exceeds a predetermined threshold.

7. The variable offset joint of claim 6, wherein the predetermined threshold is based upon a tensile force of about 2,500 to about 8,000 pounds.

8. The variable offset joint of claim 6, wherein the frangible neck includes a reduced cross-sectional area.

9. The variable offset joint of claim 1, wherein the plurality of intermediate elements are adapted to maintain the first downhole member generally parallel with the second downhole member.

10. The variable offset joint of claim 1, further including at least one electrical coupler provided to each of the first and second downhole members, at least one wire extending between the electrical couplers for communicating electrical current therebetween, and a sealed tubing enclosing the at least one wire and extending between the electrical couplers of the first and second downhole members.

11. A variable offset joint for downhole tools, including:

a first downhole member;

a second downhole member;

a plurality of intermediate elements each pivotally coupled at a first end to the first downhole member and at a second end to the second downhole member; and a coupler member extending between first and second of the plurality of intermediate elements, with a first end of the coupler member being pivotally attached directly to the first intermediate element and a second end of the coupler member being pivotally attached directly to the second intermediate element, and adapted to maintain each of the first and second downhole members at a predetermined angle relative to at least one of the plurality of intermediate elements, the coupler member being further adapted to fracture when a tensile force applied thereto exceeds a predeteunined threshold.

12. The variable offset joint of claim 11, wherein the coupler member includes a frangible neck sized to fracture when mechanical stress applied thereto exceeds a predetermined threshold that is based upon a tensile force of about 2,500 to about 8,000 pounds.

13. The variable offset joint of claim 12, wherein the frangible neck includes a reduced cross-sectional area.

14. The variable offset joint of claim 11, wherein adjusting a length of the coupler member adjusts the predetermined angle to thereby adjust a lateral offset between the first and second downhole members.

15. The variable offset joint of claim 11, further including at least one electrical coupler provided to each of the first and second downhole members, at least one wire extending between the electrical couplers for communicating electrical current therebetween, and a sealed tubing enclosing the at least one wire and extending between the electrical couplers of the first and second downhole members.

* * * * *

UNITED STATES PATENT AND TRADEMARK OFFICE

CERTIFICATE OF CORRECTION

PATENT NO. : 8,291,973 B2
APPLICATION NO. : 12/724641
DATED : October 23, 2012
INVENTOR(S) : Timothy Joseph Johnson et al.

It is certified that error appears in the above-identified patent and that said Letters Patent is hereby corrected as shown below:

In the Specifications:

In column 2, line 55, delete "invent ion" and insert therefor --invention--.

Signed and Sealed this
Fourteenth Day of May, 2013

Teresa Stanek Rea
*Acting Director of the United States Patent and Trademark Office*